United States Patent [19]

Cotey

[11] Patent Number: 4,690,345

[45] Date of Patent: Sep. 1, 1987

[54] PORTABLE DISPENSER FOR ROLLED PAPER PRODUCTS

[76] Inventor: John Cotey, 27 W. End Ave., Haddonfield, N.J. 08033

[21] Appl. No.: 846,201

[22] Filed: Mar. 31, 1986

[51] Int. Cl.[4] ..... B65H 19/00; B65D 85/66

[52] U.S. Cl. ..... 242/55.53; 242/55.54; 206/416

[58] Field of Search ..... 242/55.2, 55.42, 55.53, 242/55.54, 132, 137, 138, 146; 206/397, 408, 413–416; 211/16, 45; D6/521, 518, 522, 523

[56] References Cited

U.S. PATENT DOCUMENTS

| | | | |
|---|---|---|---|
| 2,059,267 | 11/1936 | Nichols | 206/416 |
| 3,539,124 | 4/1969 | Belokin, Jr. | 242/55.54 |
| 3,843,071 | 10/1974 | Graham | 206/414 X |
| 4,012,007 | 3/1977 | Cunningham | 242/55.54 |
| 4,030,676 | 6/1977 | Bardsley | 242/55.54 |
| 4,058,216 | 11/1977 | Tsuyuguchi | 206/416 X |
| 4,248,391 | 2/1981 | Ness | 242/55.54 |
| 4,273,299 | 6/1981 | Ness | 242/55.54 |

FOREIGN PATENT DOCUMENTS

| | | | |
|---|---|---|---|
| 285769 | 2/1928 | United Kingdom | 242/55.54 |

*Primary Examiner*—Stuart S. Levy
*Assistant Examiner*—David Werner
*Attorney, Agent, or Firm*—Eugene E. Renz, Jr.

[57] ABSTRACT

A portable dispenser for rolled paper products such as paper towels, comprising a base member and a cap member. The base is disc-shaped with an inwardly dished conical inner face. A centrally located upstanding retention means for non-rotatably engaging one end of the hollow inner core of a roll of paper towels, coaxial with the disc, projects from this inner face. An upstanding flange encircles the circumference of the disc, encasing one axial end of a roll of towels. The disc-like base has a flat, smooth outer face having a centrally located pivot on which the base member will rotate. The cap member is also disc-shaped with an inwardly dished conical inner face. A centrally located upstanding retention means for non-rotatably engaging the opposite end of the hollow inner core of the roll of paper towels projects from this inner face of the cap member. An upstanding knob or handle with an optional closed top projects from the outer face of the cap. The base member can be placed on any horizontal support surface so that the towel roll is held vertically. With one hand grasping or pushing down on the upstanding knob of the cap member, towel sheets may be pulled from the roll with the other hand. The entire dispenser assembly rotates about the center axis on the pivot of the base member.

5 Claims, 5 Drawing Figures

PORTABLE DISPENSER FOR ROLLED PAPER PRODUCTS

FIELD OF THE INVENTION

The present invention relates to dispenser assemblies for rolled paper such as paper towels or toilet tissue.

BACKGROUND OF THE INVENTION

Dispensers for rolled paper products are not new per se. For example, there are wall-mounted paper product holders or dispensers consisting of an elongated bracket positioned with longitudinal axis generally horizontal and having two upstanding arms, usually connected by hinges to opposite ends of the bracket. This elongated bracket must be mounted with screws or adhesive to a planar vertical support surface, such as a wall. To install a roll of paper towels, the hinged arms are flexed open and, at the same time, the hollow inner core of the roll is positioned generally horizontally between aligned projections on the inner surfaces of the arms. Next, each of these projections is fully inserted into the respective ends of the inner core of the roll.

These wall mounted holders have certain disadvantages. Complicated assembly, including mounting the holder with screws or adhesive, is not only time consuming, but also causes wall surface damage. Mounted holders cannot readily be moved to different locations for use. Permanently mounted holders are not appropriate nor esthetically pleasing for many locations in the home since they cannot be stored out of view. In additon, rolls of paper towels are difficult to install into these wall-mounted holders. The roll must be manipulated between the two outwardly flexed arms until the aligned projections on the arm inner surfaces can be inserted into the inner core of the roll. Furthermore, these arms may break when over-extended. After repeated flexing, the arm hinges tend to relax and, consequently, the arms will no longer securely hold the roll of paper towels.

Other wall-mounted holders consist of brackets with stationary, upstanding arms having aligned openings in the inner arm surfaces. To install a roll of paper towels, the hollow inner core of the roll is placed around an extensible, spring-loaded support rod. The axial ends of this rod are depressed so that the entire length of the rod, with towel roll suspended therefrom, passes between the inner arm surfaces. Each axial end of the rod is manipulated on the inner arm surface until it is inserted into the aligned openings. Disadvantages have also been found with these holders. Permanent mounting with fasteners causes wall surface damage. The holder cannot readily be moved to other locations, nor stored out of view. Finally, rolls of paper towels are difficult to install. The extensible rod with a towel roll suspended therefrom must be manipulated between the inner surfaces of the rod and fully inserted into aligned openings. Towel roll and rod often fall from the holder when towel sheets are forcefully pulled from the roll or when the extensible rod is out of position.

Another type of surface-mounted paper roll holder is described in Ness, U.S. Pat. No. 4,248,391, entitled HOLDER FOR ROLLS OF PAPER. The first element, a stationary base, consists of a flat annular rim surrounding an upstanding frustoconical projection. The bottom surface of this rim is permanently mounted with adhesive to a planar, horizontal support surface, such as a counter top. The second element, a rotatable member, consists of an annular flat rim surrounding an upstanding, hollow frustoconical projection. The frustoconical projection of the rotatable member nests around the projection of the base member and is rotatable with respect thereto. To install, the hollow inner core of a roll of paper towels must be jammed around the upstanding frustoconical projection of the rotatable member so that there is no relative movement between the roll and the rotatable member. The rotatable member rotates with respect to the base member as paper towel sheets are pulled from the roll. Frictional contact between the outer surface of the upstanding projection of the base and the inner surface of the upstanding projection of the rotatable member provides some braking action to prevent undesired rotation of the rotatable member and paper towel roll.

Like the wall-mounted holders, the holder described in Ness has been found to have certain disadvantages. This holder requires adhesive or some fastening means, adding additional cost and assembly time. Such permanently mounted holders cause surface damage and are not appropriate for many locations in the home. Mounted holders cannot be quickly moved or stored out-of-view. Although frictional contact between the base member and rotatable member supplies a braking action between those members, this holder does not have the means to prevent undesired unraveling of towel sheets.

SUMMARY OF THE INVENTION

The invention comprises a dispenser for rolled paper products with two elements manufactured using conventional plastic molding methods. The invention is ready for use without complicated assembly and does not require mounting with fasteners or adhesive.

The first element, a base member, is provided with a disc-like base having an inner face with an inwardly dished conical face confronting one axial end of the roll of paper, such as a roll of paper towels. An upstanding projection centrally located on this dished face and coaxial with the base member disc provides means for engaging and retaining the hollow inner core of the axial end of a roll of paper towels. The flat outer face of the disc has a small teat-like projection located at the center which acts as a pivot during dispenser rotation. An annular depending circumferential bead, concentric with the disc, forms a slight lip on the outer face of the disc.

The other element of the dispenser, a cap member, is comprised of a disc with an inwardly dished conical inner face having a central, coaxial, upstanding projection engageable into the opposite axial end of the hollow inner core of the roll of paper towels. An upstanding knob or handle projects from the outer face of the disc and is either gripped or pushed downward when dispensing towel sheets.

To install a roll of towels, each projection on the tapered inner face of the base and cap members is inserted fully into the respective axial ends of the hollow inner core of the roll. The tapered inner faces are in fricitonal contact with the edges of the towel sheets. The pivot projection and annular depending cirumferential bead on the outer face of the base contact a planar support surface to support the roll of paper towels vertically.

To dispense towel sheets, the knob or handle of the cap member is simply grasped between two fingers or pushed down with the palm of the hand while towel sheets are pulled from the roll with the other hand. The entire dispenser, including the base member, cap member and towel roll rotates about the vertical center axis on the pivot of the base member the dome-shaped projection. Downward pressure on the cap member causes the inwardly dished faces of the cap and base member to maintain frictional contact with the outermost sheets of the roll of towels, even as towel sheets are progressively removed, preventing undesired towel sheet unraveling.

This portable dispenser for rolled paper products has other distinct advantages over the surface mounted units. The present invention does not require fasteners or adhesive, eliminating mounting time and the consequent damage to surfaces caused by the prior art. Towel roll installation also is simplified with the present invention. Each of the two members can be independently inserted into the respective ends of the hollow inner core of a roll of towels without complicated manipulation required by wall-mounted holders. The present invention does not have hinges or other pieces susceptible to wear and breakage. The portable dispenser securely engages the roll of towels between base and cap members. By contrast, wall-mounted holders have been found to release the entire roll during normal operation. While fully assembled, the entire dispenser, including base member, cap member and roll of towels, readily may be moved to alternate locations for use. The entire dispenser assembly also may be stored out of view. Further advantages of the present invention will become apparent from the following description of the preferred embodiments.

DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENTS

Figure 2:
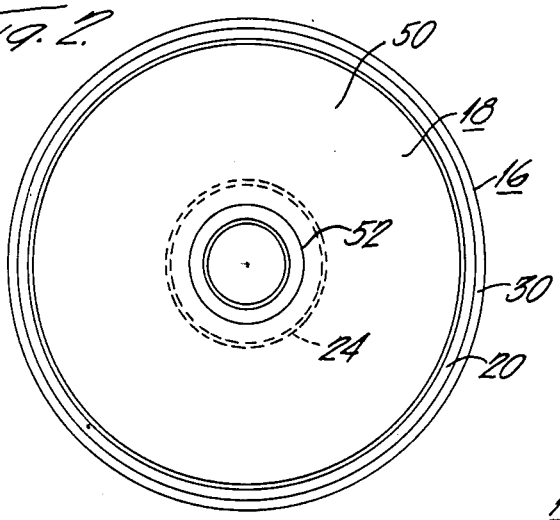
FIG. 2 is a top plan view of the base member.
Figure 3:
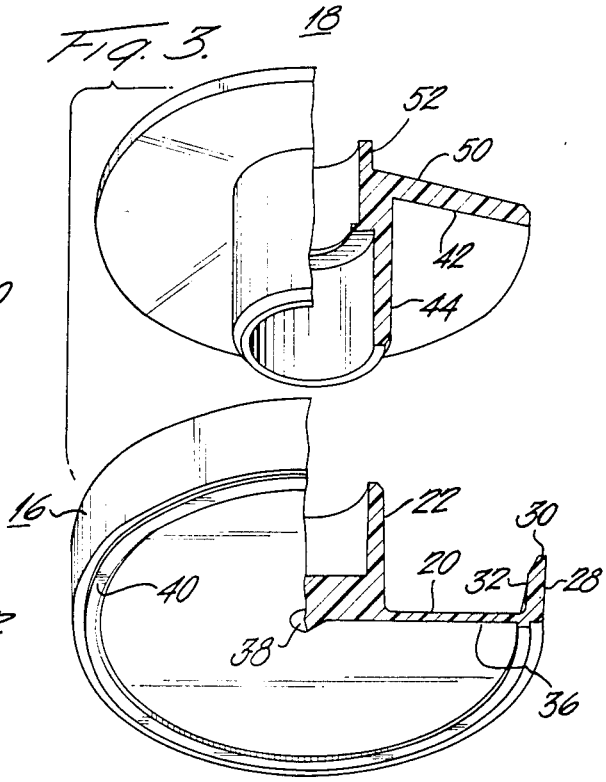
FIG. 3 is an exploded perspective view partly in section of the elements comprising the dispenser.
Figure 1:
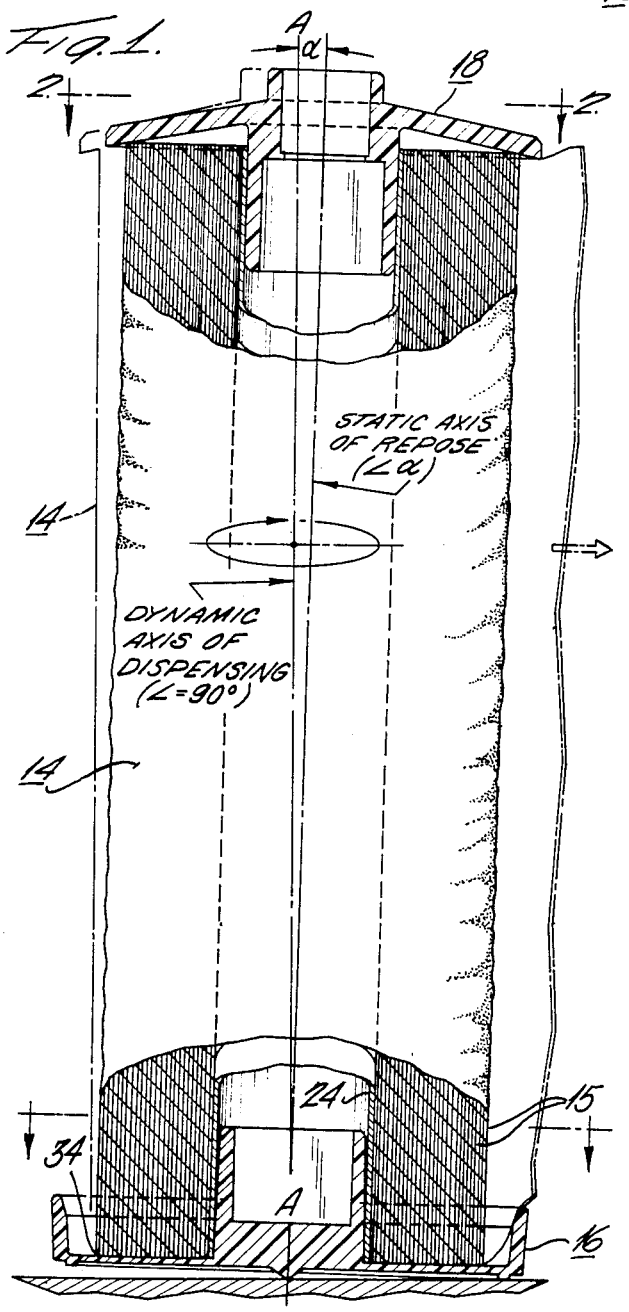
FIG. 1 is a view in side elevation partly in section of an assembly of the present invention with an installed roll of paper shown in broken lines.

FIGS. 1 to 3 show a portable dispenser for rolled paper products that have a hollow inner core, such as rolls of paper towels or toilet tissues. The dispenser in FIG. 1 illustrates the use of this invention with a roll of paper towels 14. The dispenser comprises two members, namely a rotatable base member 16 and a cap member 18.

The base member 16, shown in FIGS. 1 and 3, is disc-shaped, having a flat inner face 20. A centrally located upstanding cylindrical projection 22, coaxial with the disc, provides means for non-rotatably engaging the hollow inner core 24 of a roll of paper towels. The projection 22 has a diameter approximately equal to that of the standard inner core of a roll of paper towels and a height sufficient to firmly engage the roll, for example, a height of one inch. To engage the roll of paper towels 14, the upstanding cylindrical projection 22 is inserted into one end of the hollow inner core 24 of the roll. An upstanding flange 28, slightly flared outward, forms a circumferential wall surrounding the disc. The inner surface 32 of the flange is bevelled to form a rounded upper edge 30. The disc-like base is of a predetemined diameter so that the upstanding outer flange 28 encircles the outermost sheets 15 on the axial end 34 of the full roll of paper towels. The base member 16 and flange 28 encase the bottom end of the roll, preventing liquid on counter tops or other support surfaces from seeping into the towel sheets. The flange 28 also prevents undesired towel sheet unraveling by holding the outermost sheet 15 within the dispenser.

The smooth and flat outer face 36 of the disc-like base member has a centrally located teat-like projection 38 which serves as the pivot during rotation of the base member. An annular depending bead 40, concentric with the disc, forms a raised lip near the circumferential edge on the outer face 36 of the base. The pivot projection 38 extends slightly below the plane of the lower edge of the bead 40 so that the roll of towels is supported generally vertically.

The second element of the dispenser, the cap member 18, is shown in FIG. 3. This generally disc-shaped cap member has an inwardly-dished conical face 42, preferably tapered about 5°. A centrally located downwardly extending cylindrical projection 44, coaxial with the disc, provides means for non-rotatably engaging the hollow inner core 24 of the roll of paper towels. The projection 44 has a diameter approximately equal to that of the standard inner core diameter of a roll of paper towels and is of a height sufficient to firmly engage the roll, for example, a height of one inch. The upstanding cylindrical projection 44 is inserted into the opposite axial end of the inner core 24 of the roll.

On the outer face 50 of the disc-shaped cap member, a centrally located upstanding cylindrical hollow knob or handle 52 projects from the outwardly dished face and is coaxial with respect thereto. The knob 52 is polished and provides a means for grasping the portable dispenser both during use and when moving the dispenser to alternate locations. The disc-shaped cap member prevents water from seeping into the upper axial end of a roll of paper towels.

To install the dispenser, the cylindrical projections 22, 44 projecting from the inwardly dished face 42 of the cap member and the flat face 20, of the base member and cap members are inserted into the respective axial ends of the hollow inner core 24 of a roll of paper towels 14. (FIG. 1) The inwardly dished face 42 is in contact with the edges of the towel sheets on the upper axial end of the roll. The upstanding outer flange 28 of the base member encircles the outermost sheets 15 of the roll of towels 14. The smooth, flat outer disc face of the base member 36 can be placed on any planar support surface so that the dome-shaped projection or pivot 38 and the annular bead 40 are in contact with such support surface. The dispenser holds the paper towels vertically. By applying slight downward pressure on the knob 52, towel sheets may be pulled from the roll singly or in series with the other hand. The entire dispenser assembly—base, cap and roll—rotates about the center axis A—A on the pivot 38 of the base member 16. Downward pressure on the knob 52 stabilizes the dispensing action and causes the inwardly dished face 42 to maintain contact with the outermost sheets of the roll of towels, preventing undesired towel sheet unraveling.

Figure 4:
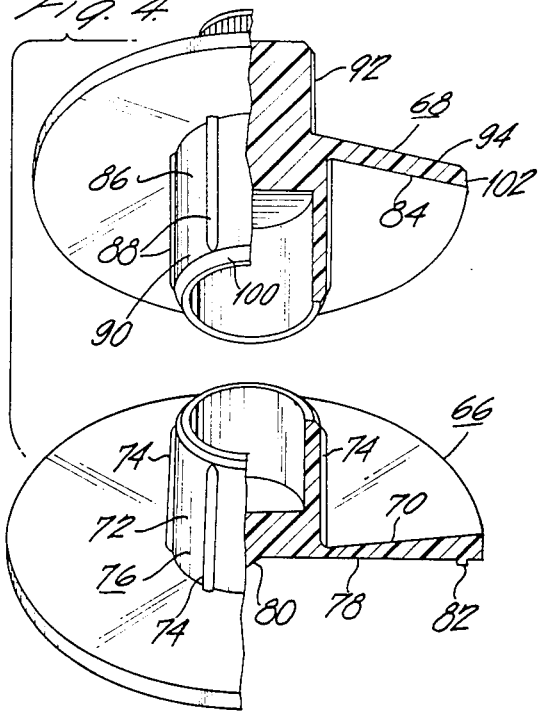
FIG. 4 is an exploded perspective view partly in section of still another form of dispenser in accordance with the present invention.

FIG. 4 illustrates an alternate embodiment for a portable dispenser for rolled paper products. The two elements of the dispenser, the cap member 68 and base member 66, are similar to those previously described as shown in FIGS. 1 to 3.

The cap and base members, the base member 66 is similar to that shown in FIGS. 1 and 3 but having an inwardly dished conical inner face 70 of the disc-like base and preferably tapered about 5°. A centrally located upstanding cylindrical projection 72 provides means for engaging one axial end of the hollow inner core 24 of the roll of paper towels 14. A circumferential series of vertical, rib-like splines 74 is located on the outer surface 76 of the projection. This base member 66 differs from the base of FIG. 2 in addition that it does not include the upstanding flange surrounding the disc circumference.

The outer face of the base member in this alternate embodiment is identical to that shown in FIGS. 1 and 3. The smooth, outer flat disc face 78 has a centrally located teat-like projection 80 which serves as the pivot during rotation of the base member. A depending annular bead 82 forms a lip near the outer circumferential edge of the base. When not in use, the base member 66 rests on any planar support surface with pivot 80 and a portion of the annular bead 82 in contact with such surface to support the roll of towels 14 in a generally vertical position.

The cap member 68 of the alternate embodiment (FIG. 4) is similar to that shown in FIG. 3. The cap has an inwardly dished conical inner face 84, preferably tapered about 5°. A downwardly extending upstanding cylindrical projection 86 provides means for non-rotatably engaging the opposite axial end of the hollow inner core 24. A circumferential series of vertical rib-like splines 88, located on the outer surface 90 of this projection, ensures a friction fit beween the hollow inner core 24 of the roll and the projection 86.

The cap member of this embodiment differs from that previously described in that the frustoconical knob or handle on the outer disc face 94 has been replaced by an upstanding solid cylindrical projection 92. This cylindrical projection 92 has a height sufficient to enable an individual to grasp the projection when moving the dispenser. The outer surfaces of the knob 92 is polished smooth with a beveled edge to allow free turning in the palm of the hand when dispensing paper products. The edge 100 of the cylindrical projection is beveled for ease of insertion into the core of the paper roll.

To install this alternate embodiment of the dispenser, the splined cylindrical projections 72, 86 of the base and cap members are fully inserted into the respective axial ends of the hollow inner core 24 of a roll of towels 14 so that the axial ends of the roll are in frictional contact with the tapered inner faces 70, 84 of the base and cap member. With the dome-shaped projection and annular bead of the outer disc face of the base member in contact with a horizontal support surface, the dispenser holds the roll of towels generally vertically. The user grasps cylindrical projection 92 of the cap member with one hand to allow free rotation as the other hand removes selected towel sheets. Thus, the entire dispenser assembly rotates about the center axis A—A on the pivot 80 of the base member 66 as shown in FIG. 1. Applying downward pressure to the cap 68 will ensure that the tapered inner disc faces 70, 84 of the cap and base will firmly engage the upper and lower edges of the outermost towel sheets. As towel sheets are progressively removed, this continual frictional engagement of outer sheets prevents undesired unraveling.

Figure 5:
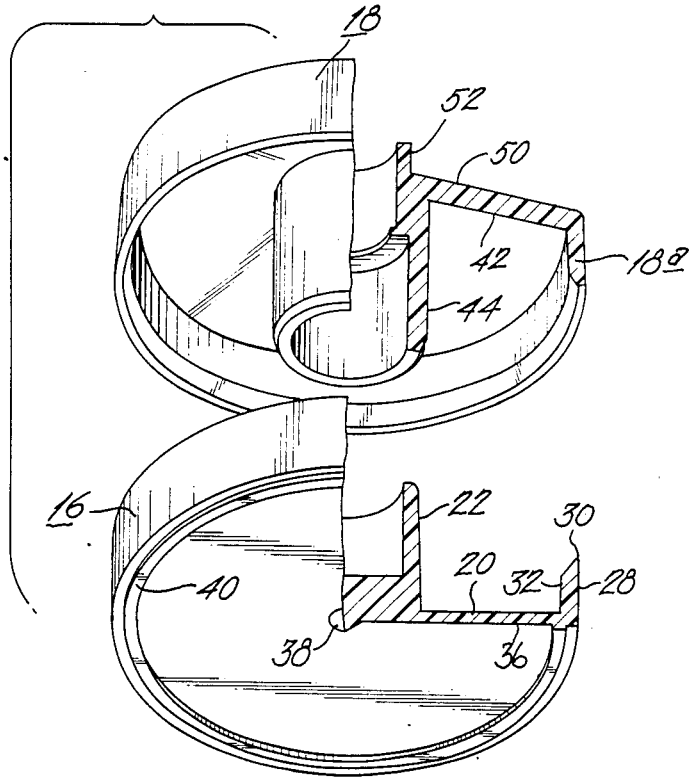
FIG. 5 is a perspective view partly in section of a still further modified dispenser in accordance with the present invention.

FIG. 5 shows a further modified dispenser in accordance with the present invention. The dispenser is similar to that shown in FIG. 3 except that the present instance, the cap member 18 has a circumferentially extending, depending flange **18*a* at the outer edge of the face 42** which acts as an additional element preventing unraveling of the paper towels.

What is claimed is:

1. A portable dispenser for a roll of paper having a hollow inner core and two opposing axial ends, comprising:

a disc-like rotatable base member having an inwardly planar inner face and an upstanding retention means for firmly, non-rotatably engaging one axial end of the hollow inner core of a roll of paper, said base member having an outer face with a centrally located downward projection forming a pivot, said pivot providing means for supporting the base during rotation and an annular depending rib spaced radially outwardly of the pivot;

a cap member having an inwardly dished conical inner face and a downwardly extending rentention means for firmly, non-rotatably engaging the hollow inner core at the opposite axial end of the roll of paper, said cap member having an outer face with an upstanding projection providing means both for grasping the dispenser and for applying downward pressure on the cap member and dispenser assembly during paper sheet dispensing.

2. A dispenser of claim 1 wherein said retention means includes a projection and a circumferential series of splines on the outer surfaces of said projections of said base and cap members.

3. A dispenser of claim 1 wherein the inner face of said base member has a peripheral upstanding outer flange which encircles the lower edges of the outermost sheets of one axial end of the roll of paper.

4. A dispenser of claim 1 wherein said upstanding projection on the outer face of the cap member comprises a cylindrical knob or handle having a closed top surface.

5. A dispenser of claim 1 wherein said upstanding projection on the outer face of the cap member comprises a hollow cylinder.

* * * * *